US011795942B2

(12) United States Patent
Wojciechowski, III

(10) Patent No.: US 11,795,942 B2
(45) Date of Patent: Oct. 24, 2023

(54) HIGH PRESSURE WATER PUMP FLUID END

(71) Applicant: NLB Corp., Wixom, MI (US)

(72) Inventor: Donald Anthony Wojciechowski, III, Fenton, MI (US)

(73) Assignee: NLB Corp., Wixom, MI (US)

( * ) Notice: Subject to any disclaimer, the term of this patent is extended or adjusted under 35 U.S.C. 154(b) by 49 days.

(21) Appl. No.: 17/095,265

(22) Filed: Nov. 11, 2020

(65) Prior Publication Data

US 2021/0140426 A1 May 13, 2021

Related U.S. Application Data

(60) Provisional application No. 62/933,710, filed on Nov. 11, 2019.

(51) Int. Cl.

| | |
|---|---|
| ***F04B 53/16*** | (2006.01) |
| ***F04B 53/10*** | (2006.01) |
| ***F04B 53/22*** | (2006.01) |
| ***F04B 53/02*** | (2006.01) |
| ***F04B 37/12*** | (2006.01) |

(52) U.S. Cl.

CPC ..... *F04B 53/16* (2013.01); *F04B 53/10* (2013.01); *F04B 53/22* (2013.01); *F04B 37/12* (2013.01); *F04B 53/02* (2013.01)

(58) Field of Classification Search

CPC ..... F04B 53/16; F04B 53/10; F04B 53/22; F04B 37/12; F04B 53/02; F04B 53/102; F04B 53/1032; F04B 37/16

See application file for complete search history.

(56) References Cited

U.S. PATENT DOCUMENTS

| | | | | |
|---|---|---|---|---|
| 5,171,136 | A * | 12/1992 | Pacht | F04B 53/1025 417/571 |
| 6,171,070 | B1 * | 1/2001 | Mitake | F04B 53/147 417/63 |
| 7,121,812 | B2 | 10/2006 | Forrest | |
| 8,221,100 | B2 | 7/2012 | Forrest et al. | |
| 2002/0079383 | A1 * | 6/2002 | Forrest | B05B 9/0413 239/381 |
| 2004/0161351 | A1 * | 8/2004 | Forrest | F04B 53/22 417/567 |

FOREIGN PATENT DOCUMENTS

| | | | | |
|---|---|---|---|---|
| DE | 10160168 | A1 * | 6/2003 | F04B 53/007 |

OTHER PUBLICATIONS

DE10160168 translation (Year: 2022).*

* cited by examiner

*Primary Examiner* — Kenneth J Hansen
*Assistant Examiner* — David N Brandt
(74) *Attorney, Agent, or Firm* — Carlson, Gaskey & Olds, P.C.

(57) ABSTRACT

A cartridge assembly for use in a high pressure pump according to an exemplary aspect of the present disclosure includes, among other things, a cartridge housing. A bore extends through the cartridge housing from a valve end to a packing end. A valve assembly is arranged in the valve end of the bore and configured to abut a valve seat. The bore has a constant diameter between the valve assembly and the packing end. The cartridge assembly is designed to be used in a fluid pump at a fluid pressure of at least 30,000 psi.

12 Claims, 4 Drawing Sheets

HIGH PRESSURE WATER PUMP FLUID END

PRIORITY CLAIM

This application claims the benefit of U.S. Provisional Application No. 62/933,710, filed on Nov. 11, 2019.

BACKGROUND

This application relates to a fluid end cartridge for use in a high pressure water pump.

High pressure water pumps are known, and may operate at pressures up to 55,000 psi. These pumps may be used to perform water jetting operations such as surface preparation, cutting, cleaning, coating removal, and other operations. These pumps typically use a fluid cylinder having reciprocating plungers to force the fluid out of an applicator at extremely high pressure. As the plungers reciprocate within the fluid cylinder, the fluid cylinder and components thereof cycle between atmospheric and maximum system pressure.

SUMMARY

A cartridge assembly for use in a high pressure pump according to an exemplary aspect of the present disclosure includes, among other things, a cartridge housing. A bore extends through the cartridge housing from a valve end to a packing end. A valve assembly is arranged in the valve end of the bore and configured to abut a valve seat. The bore has a constant diameter between the valve assembly and the packing end. The cartridge assembly is designed to be used in a fluid pump at a fluid pressure of at least 30,000 psi.

In another aspect of this disclosure, a cartridge assembly for use in a high pressure pump includes, among other things, a cartridge housing. A bore extends through the cartridge housing from a valve end to a packing end. A valve assembly is arranged in the valve end of the bore and configured to abut a valve seat. A retainer flange is removably secured to the cartridge housing at an end of the cartridge housing.

These and other features of the present invention can be best understood from the following specification and drawings, the following of which is a brief description.

BRIEF DESCRIPTION OF THE DRAWINGS

The drawings can be briefly described as follows.

DETAILED DESCRIPTION

Figure 1:
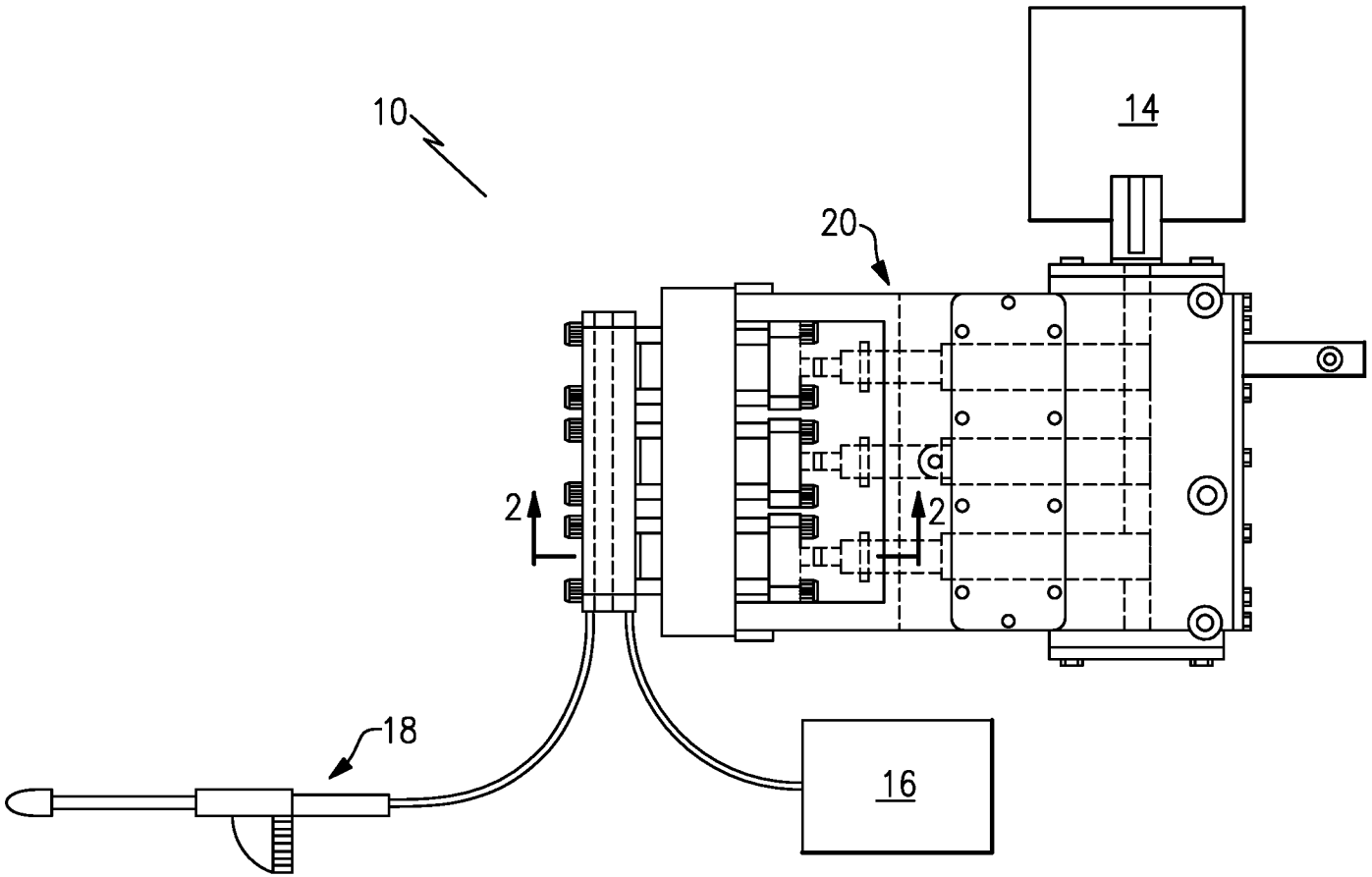
FIG. 1 is a partial schematic view of a high pressure fluid jetting system.

FIG. 1 schematically illustrates an exemplary high pressure fluid jetting system 10. The system 10 generally includes a pump fluid end 20, a drive assembly 14, a pressurized fluid supply 16, and an applicator gun 18. The drive assembly 14 may include a diesel or electric powered motor, for example. The pump fluid end 20 operates to selectively jet water from the gun 18 at very high pressures. A bypass valve may provide for fine tuning of the system pressure, in some examples.

Figure 2:
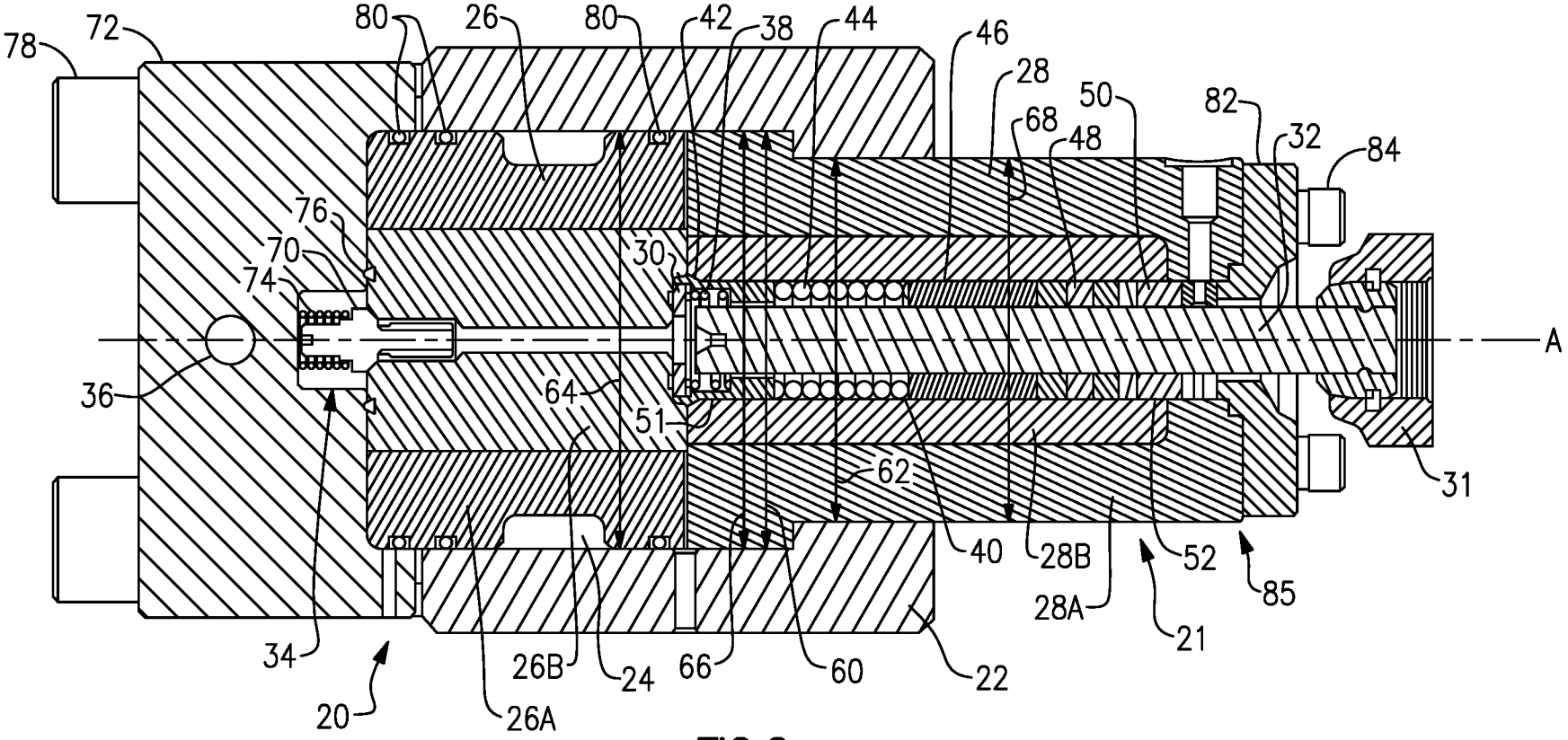
FIG. 2 is a cross-sectional view through an example fluid end.

FIG. 2 illustrates a cross-sectional view of an example pump fluid end 20 having an outer frame plate 22 and a seal cartridge 21. Water is directed into a plenum 24 in a valve seat 26 to a valve 30 and into a chamber. A plunger 32 is reciprocally driven, which pressurizes the water in the chamber, and forces the water to exit the cartridge 21 through a discharge valve assembly 34 and discharge passage 36. The plunger 32 reciprocates along an axis A, and may be driven by a motor, for example. The plunger 32 may be connected to the drive assembly 14 at a drive end 31. The high pressure water may then be utilized for water jetting operations. This disclosure is not limited to any particular pressure rating for the high-pressure pump, but example pressures include pumps capable of generating water pressures within a range of about 3,500 to 55,000 pounds per square inch (psi). In one example, the cartridge 21 generates a pressure of about 40,000 psi. While water is specifically referenced herein, the high-pressure pump could be used to pressurize other fluids.

The frame plate 22 may contain multiple inlets circumferentially spaced about the cartridge 21 in communication with the plenum 24. The valve 30 is mounted within a recess in the valve seat 26. A valve guide 42 is arranged within the housing 28. The valve 30 is biased against the valve seat 26 by a valve spring 38 to close off the flow of water from the plenum 24. The valve spring 38 is arranged radially inward of the valve guide 42. In one example the valve seat 26 may be formed of two portions, an outer valve seat portion 26A and an inner valve seat portion 26B, and the cartridge housing 28 may be formed of two portions, an outer housing 28A and an inner housing 28B. In other embodiments, the valve seat 26 and the cartridge housing 28 may each be formed from a single piece. A bore 40 extends through the inner housing 28B and receives the plunger 32. The bore 40 extends generally along the axis A. A plurality of seals 80, such as o-rings, may be arranged near an outer diameter of the valve seat 26.

A packing spring 44 is arranged within the bore 40. The packing spring 44 may be arranged between the valve guide 42 and a bushing 46, for example. The bushing 46 has a length along the axis A that may be longer than a diameter of the plunger 32, for example. A packing assembly 48 and backup ring 50 may be arranged along the bore 40. This arrangement eliminates the need for a shoulder within the bore 40. That is, the bore 40 has a constant diameter along substantially its entire length. In this example, the bore 40 is tapered at one end but otherwise exhibits a constant diameter along its entire length. The bore 40 extends from a valve end 51 to a packing end 52. In one example, the bore 40 has a constant diameter between the valve guide 42 and the packing end 52 beyond the packing assembly 48. At no point along the inner housing 28B does the inner housing 28B contact the plunger 32.

In one example, the frame plate has a major inner diameter 60 of about 3.757 inches and a minor inner diameter 62 of between about 3.255 and 3.257 inches. The valve seat 26 has an outer diameter of about 3.755 inches. The valve seat 26 has an outer diameter 64 of between about 3.754 and 3.756 inches. In another example, the valve seat outer diameter 64 may be between 3.700 and 3.756 inches. The cartridge housing 28 has a major outer diameter 66 of about 3.7552 inches and a minor outer diameter 68 of about 3.2534 inches. The cartridge housing major outer diameter 66 may be between about 3.750 and 3.760. The cartridge housing minor outer diameter 68 may be between about 3.243 and 3.253. In a further embodiment, the cartridge housing minor outer diameter 68 is about 3.248. The disclosed dimensions illustrate the referenced parameters within 10% of the desired values. In another example, the referenced parameters are within 5% of the desired values, and in another example, the reference parameters are within 2% of the desired values. In some examples, the dimensions are within 0.001 inches of the disclosed values. In an example, a difference between the cartridge housing major outer diameter 66 and the cartridge housing minor outer diameter 68 is about 0.5 inches. A ratio of the cartridge housing outer diameter 66 and the cartridge housing minor diameter 68 is about 1.15. The frame plate major inner diameter 60 is slightly larger than the cartridge housing major outer diameter 66 and the valve seat outer diameter 64 to accommodate a tolerance in assembling these components. The frame plate minor inner diameter 62 is slightly larger than the cartridge housing minor outer diameter 68. The aforementioned ratios and dimensions, both individually and combined, provide a low-cost design which exhibits improved performance, especially at substantially high operating pressures, such as in pumps designed to operate between 30,000 and 55,000 psi. In an example, the cartridge assembly is designed to be used at pressures between 35,000 and 50,000 psi. In a further example, the cartridge assembly is designed to be used at about 40,000 psi.

The discharge valve assembly 34 includes a discharge valve 70 biased within a discharge manifold 72 by a discharge valve spring 74. The discharge valve assembly 34 is biased to a closed position by the discharge valve spring 74. The discharge manifold 72 is secured to the cartridge 21 at a discharge end and houses the discharge passage 36. The discharge manifold 72 may be secured to the frame plate 22 and/or the valve seat 26 with fasteners 78. The fasteners 78 may be screws, for example. A seal 76, such as an o-ring, may be arranged between the discharge manifold 72 and the valve seat 26.

A retainer flange 82 is mounted at an end 85 of the cartridge 21. The retainer flange 82 is secured to the cartridge 21 with bolts 84. A lock washer may be used at the bolts 84. This arrangement may allow for easier access to the inside bore surface, which may allow particular processes to enhance the inside surface and may reduce manufacturing cost.

Figure 3:
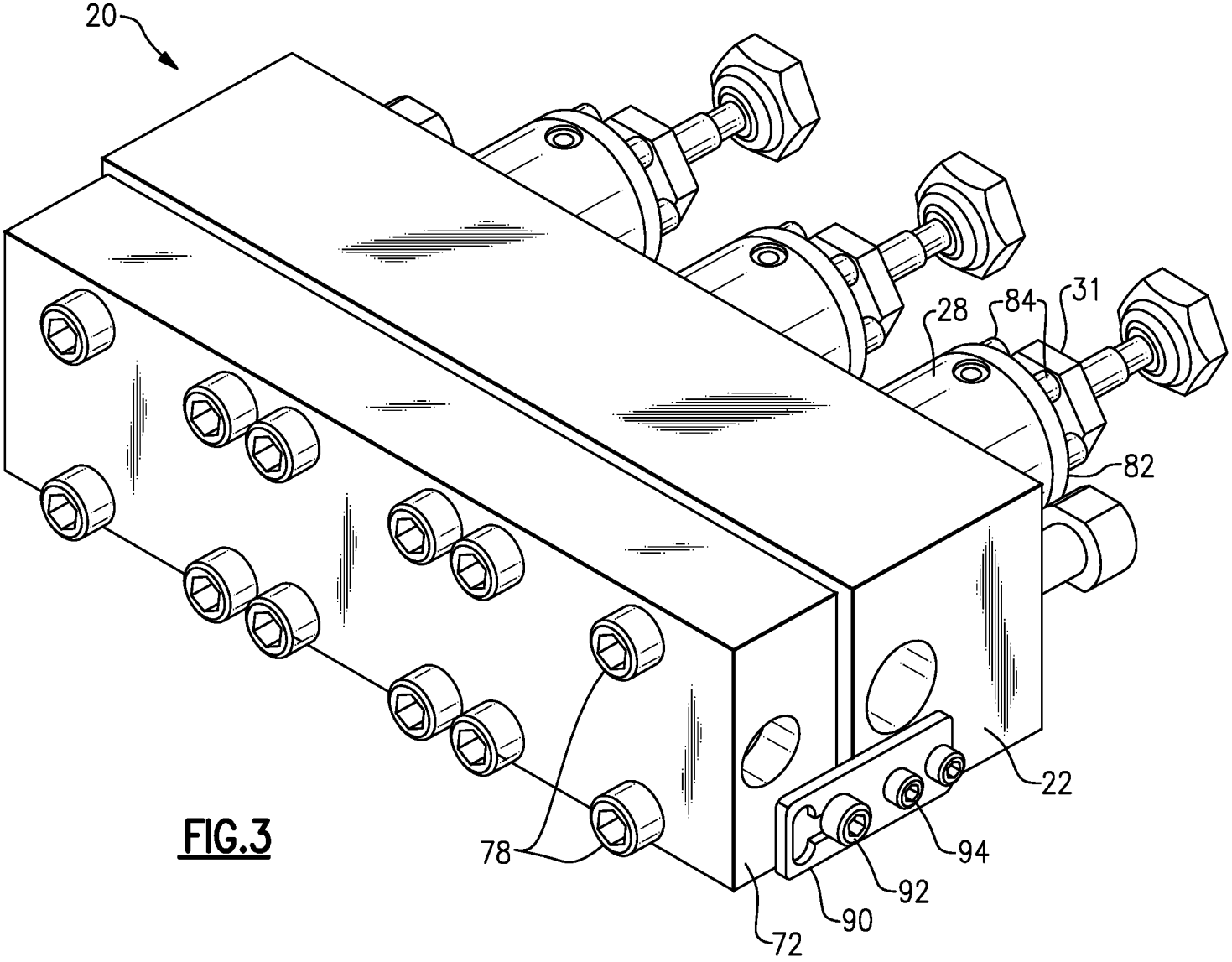
FIG. 3 is a view of the example fluid end.

FIG. 3 illustrates another view of the example fluid end 20. Although FIG. 2 illustrates a single pump chamber, in practice, multiple pump chambers may be mounted in parallel. In this example, three pump chambers are utilized. In other examples, more or fewer pump chambers may be used. When the drive end 31 of the plunger 32 is moved (shown in phantom), water flows into the cartridge 21, and then is pressurized and pushed out through the discharge manifold 72. The discharge manifold 72 and the frame plate 22 may be separable to remove and replace the cartridges 21. Different cartridges 21 may be used for different desired pressures. The separable arrangement of the frame plate 22 permits a single pump to be used at multiple pressures by switching cartridges 21. The frame plate 22 is secured to the discharge manifold 72 via fasteners 78. In one example, a bracket 90, a screw 92, and a plurality of bolts 94 help hold the discharge manifold 72 when the fasteners 78 are removed, allowing the discharge manifold 72 to pivot out of the way. Although a particular bracket and fastener arrangement is illustrated, the frame plate 22 and discharge manifold 72 may be secured to one another with a different arrangement.

Figure 4:
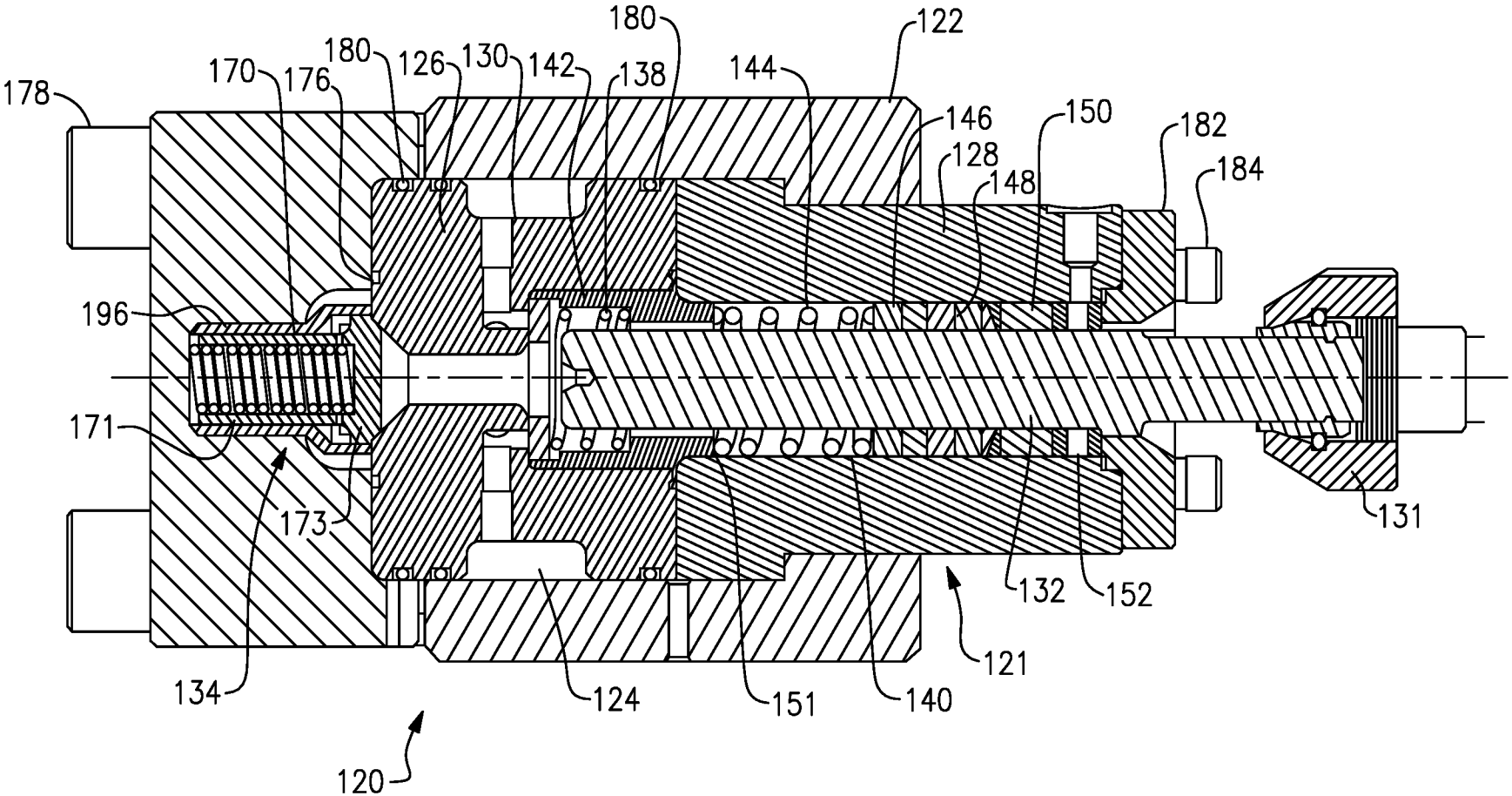
FIG. 4 is a cross-sectional view through another example fluid end.

FIG. 4 illustrates another example fluid end 120 having a cartridge 121. To the extent not otherwise described or shown, the fluid end 120 corresponds to the fluid end 20 of FIG. 2, with like parts having reference numerals preappended with a "1." In the example cartridge 121, the valve guide 142 extends into the valve seat 126. The bushing 146 may have a length that is smaller than a diameter of the plunger 132. This example also utilizes a different discharge valve assembly 134. The discharge valve 170 has a discharge valve stem 171 and a discharge valve head 173. The discharge valve 170 is received within a discharge valve guide 196. The discharge valve spring 174 is arranged within the discharge valve stem 171. The discharge valve head 173 seats against the valve seat 126. The cartridge 121 may be used at pressures between about 8,000 psi and 20,000 psi, for example. The fluid end 120 may have the same frame plate 122 and cartridge seal housing 128 dimensions as the fluid end 20. This permits the cartridges 21, 121 to be used interchangeably within the same pump for differing fluid pressures.

The disclosed cartridges 21, 121 eliminate a shoulder within the bore of known cartridges. This design instead utilizes a suction valve stop and guide trapped between the cartridge and the valve seat. This arrangement allows the force of the packing spring 44 and the suction valve spring 38 to act on the valve guide 42 and valve seat 26, respectively. Elimination of the shoulder from the bore may reduce cost and stress within the cartridge. The disclosed cartridge and pump design may produce more horsepower in a smaller package than known pumps.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A cartridge assembly for use in a high pressure pump, comprising: a cartridge housing abutting a valve seat; a bore extending from a valve end to a packing end through the cartridge housing along an axis; a valve assembly arranged in the valve end of the bore, the valve assembly including a valve, a valve guide, and a valve spring, the valve guide housing the valve spring, and the valve spring configured to bias the valve to abut the valve seat; wherein the valve seat includes an inner valve seat portion and an outer valve seat portion, the valve seat configured to be secured to a discharge manifold; wherein the bore has a constant diameter section between the valve assembly and the packing end; wherein a portion of the valve guide is housed within the constant diameter section of the bore, and the valve guide is configured to be trapped axially between the cartridge housing and the inner valve seat portion, wherein the valve guide is in direct contact with the inner valve seat portion; and wherein the cartridge assembly is configured to be used in the high pressure pump at a fluid pressure of at least 30,000 psi.

2. The cartridge assembly of claim 1, wherein a packing spring and a bushing are arranged in the constant diameter section of the bore, the packing spring arranged axially between and abutting the valve guide and the bushing.

3. The cartridge assembly of claim 2, wherein the valve guide, the bushing, and the packing spring are arranged about a plunger between the valve assembly and a packing assembly at the packing end.

4. The cartridge assembly of claim 3, wherein the bushing has a length along the plunger that is longer than a diameter of the plunger.

5. The cartridge assembly of claim 1, wherein the cartridge housing does not have a shoulder extending into the bore.

6. The cartridge assembly of claim 1, wherein a retainer flange is bolted to the cartridge housing.

7. The cartridge assembly of claim 1, wherein a ratio of a cartridge housing major outer diameter to a cartridge housing minor outer diameter is about 1.15.

8. The cartridge assembly of claim 1, wherein the cartridge housing has a major outer diameter between 3.750 and 3.760 inches.

9. The cartridge assembly of claim 1, wherein the cartridge housing has a minor outer diameter between 3.243 and 3.253 inches.

10. The cartridge assembly of claim 1, wherein a plunger extends through the bore, the plunger configured to move toward and away from the valve assembly to move fluid toward a discharge valve.

11. The cartridge assembly of claim 1, wherein the cartridge assembly is configured to be arranged in a frame plate and configured to be removable from the frame plate.

12. The cartridge assembly of claim 1, wherein the valve spring is arranged radially inward of the portion of the valve guide relative to the axis.

* * * * *